United States Patent [19]

Kölling et al.

[11] 4,333,816

[45] Jun. 8, 1982

[54] METHOD FOR THE PRODUCTION OF NEEDLE COKE

[75] Inventors: Georg Kölling, Essen; Ingo Romey, Drevenack; Hellmut Kokot, Essen, all of Fed. Rep. of Germany

[73] Assignee: Bergwerksverband GmbH, Essen, Fed. Rep. of Germany

[21] Appl. No.: 179,281

[22] Filed: Aug. 18, 1980

[30] Foreign Application Priority Data

Feb. 22, 1980 [DE] Fed. Rep. of Germany ..... 3006694

[51] Int. Cl.[3] ..... C10G 9/14

[52] U.S. Cl. ..... 208/91; 208/131

[58] Field of Search ..... 208/131, 39, 85, 91

[56] References Cited

U.S. PATENT DOCUMENTS

| | | | |
|---|---|---|---|
| Re. 25,467 | 10/1963 | Logan | 208/39 |
| 4,104,150 | 8/1978 | Romey | 208/131 |
| 4,111,794 | 9/1978 | Pietzka | 208/131 |

FOREIGN PATENT DOCUMENTS

| | | | |
|---|---|---|---|
| 2614490 | 10/1977 | Fed. Rep. of Germany | 208/131 |
| 2614541 | 10/1977 | Fed. Rep. of Germany | 208/131 |

*Primary Examiner*—T. M. Tufariello

*Attorney, Agent, or Firm*—Michael J. Striker

[57] ABSTRACT

Coal tar pitch is liquified at temperature of from about 135° C. to 280° C. The liquid coal tar pitch is filtered through a sieve with apertures from about 100 to 220 μm and with a closed surface area of at least 75 percent of the total sieve surface under pressures of from about 2 to 10 bar until a filter cake of a height of from about 40 to 80 mm forms above the sieve for separating ash, soot and quinoline insoluble particles from the liquid. Then the filtrate obtained is subjected to a coking process.

The needle cokes resulting in accordance with the invention provide excellent materials for the production of graphite electrodes.

5 Claims, No Drawings

METHOD FOR THE PRODUCTION OF NEEDLE COKE

BACKGROUND OF THE INVENTION b 1. Field of the Invention

The present invention relates to a method for production of needle coke from filtered liquidified coal tar pitch.

2. Brief Description of the Background of the Invention Including Prior Art

Needle cokes have good graphitizing properties and therefor provide a good starting material for the production of high value graphite electrodes.

It is known to produce needle cokes of good quality from coal tar pitches by liquifying the pitches through heating to a temperature of from 135° to 280° C., removing ash, soot and quinoline insoluble parts by filtration and subjecting the pitches purified in this manner to a coking process. The filtration of the pitches in the absence of a solvent is difficult and very time consuming. Therefor, the process has been employed up to now only on a very small scale in praxis, even though the filtrates from the undissolved pitches result in the best needle coke qualities.

The person skilled in the art knows that upon filtration through sieves of a pore width of from 100 to 220 μm at the beginning of filtration not inconsiderable amounts of unpurified coal tar pitch pass into the filtrate since the average size of the solid particles in the pitches lies in the range of 30 to 60 μm. Thus in reissued U.S. Pat. No. Re. 25,467 the upper limit of the aperture width of the sieves is given as 162 μm.

SUMMARY OF THE INVENTION

1. Purposes of the Invention

It is an object of the present invention to provide a process for removing ash, soot and quinoline insoluble particles from coal tar pitches.

It is another object of the invention to provide a purified coal tar pitch suitable for production of good quality needle coke.

These and other objects and advantages of the present invention will become evident from the description which follows.

2. Brief Description of the Invention

The present invention provides a method for production of needle coke which comprises liquifying coal tar pitch at temperatures from about 135° C. to 280° C., filtering the liquified coal tar pitch through a sieve with apertures from about 100 to 200 μm and with a closed surface area of at least 75 percent of the total sieve surface under pressures from about 2 to 10 bar until a filter cake of a height of from about 40 to 80 mm forms above the sieve for separating ash, soot and quinoline insoluble particles from the liquid and subjecting the filtrate obtained to a coking process.

Preferably the filtrate obtained until a filter cake height of from about 2 to 5 mm is present is recirculated to the liquified coal tar pitch. The pressure above the sieve can increase during filtration continuously and/or in steps from about 1 to 3 bars to about 6 to 10 bars. An auxiliary filtering material can be added to the liquified coal tar pitch before the filtering through the sieve.

The needle cokes obtained in accordance with the present invention provide excellent materials for producing graphite electrodes.

DETAILED DESCRIPTION OF THE PREFERRED EMBODIMENTS

In accordance with the present invention it has been found that needle cokes can be obtained by coking of suitable pitches within a suitably short time if coal tar pitch liquified by heating is filtered stepwise under pressures of from about 2 to 10 bars through sieves with apertures of from about 100 to 220 μm and with a closed surface of at least 75 percent of the total filter surface until a filter cake of a thickness of from about 40 to 80 mm has formed about the sieve.

In detail, it has surprisingly been found that the passage of coal tar pitch impurities stops upon the application of larger aperture widths already when the filter cake reaches a height of from about 2 to 5 mm and that it is of hardly noticeable disadvantage for the product that until said height of the filter cake is reached a passage of certain amounts of coal tar pitch impurities occurs. In addition about a third of the time otherwise required for the performance of the filtration, for example for sieves with apertures of from 50 to 100 μm. This advantage is more important than the production of a 100% pure filtrate, since as mentioned the quality of the needle cokes hardly suffers from this passage of impurities.

The gain in time remains also substantially when for the production of particularly high value needle cokes after the growth of the filter cake to about 2 to 5 mm the filtrate passed by then is recirculated to the top of the sieve.

Another precondition for the successful performance of the invention process is besides the selection of relatively large sieve openings the size of the closed surface of the sieves selected, which should be at least about 75 percent of the total sieve surface. The upper limit is at about 90 percent since otherwise the filtering speed is again decreased. Only with a large part of closed sieve surface a large part of the turbid particles deposits on the sieves under bridge formation over the sieve apertures practically immediately at the start of the sieve process. These bridge formations are also favored by certain adhesive properties of the solid particles in the heated coal tar pitches. Therefor, upon charging of the hot pitches a filter cake builds up very rapidly, which in the majority comprises particles which are in fact smaller than the sieve openings or respectively as the width of the mostly wedge shaped slots of the known bar screens. Thus the sieve itself acts in the present invention substantially only as the support for the filter cake. The retaining of the turbid particles is performed in the filter cake itself. If this would not be the case usually more than about 80 percent of the turbid solid particles of the pitch would pass through the sieve. Surprisingly, this is not the case.

Pitch filtrations are preferably performed at pressures of from about 2 to 10 bar. For the filtering speed of the method of the present invention it has proven to be advantageous to start the filtration at a lower pressure of from about 1 to 3 bar and to increase the pressure slowly or step by step to about 6 to 10 bars with advancing filtration.

It is advantageous to employ in the method of the present invention auxiliary filtration materials such as for example kieselguhr, activated carbon, anthracite or similar auxiliary filtering materials, which can be added in amounts from about 1 to 10 weight percent to the liquified pitches.

EXAMPLE 1

10 kg of a raw briquette pitch with a softening point of 75° C. according to Kraemer-Sarnow are heated to 275° C. and are charged with five minutes on a metal pressure filter with a mesh aperture of 140 μm and a closed surface of 78 percent at a pressure of 2 bar. At the start of the filtration for about a minute a turbid filtrate comes out of the metal pressure filter. During this time the filter cake grows to a thickness of 3 mm.

After about 10 minutes the filtration is terminated. On the filter a cake with a height of 60 mm has formed.

The filtrate is then coked in a delayed-coker at about 490° C. and 3 bar and successively in a tube furnace at 1000° C. The coke has a graphitizability of 1.47.

For comparison additional 10 kg of this briquette pitch are filtered on a metal pressure filter with commercial metal fabric with a mesh size of 90 μm at a pressure of 2 bars. The fabric has a free passage area of 58 percent. Nevertheless the filtration is terminated only after 25 minutes. A cake of 62 mm height has formed on the filter. The filter can only be used again after a very difficult and time consuming cleaning.

EXAMPLE 2

10 kg of a raw briquette pitch with a softening point of 65° C. according to Kraemer-Sarnow are heated to 240° C. and are placed together with 250 g kieselguhr (diatomaceous earth) on a wedge grate filter with a slot width of 190 μm at a pressure of from 1 to 5 bar. The closed surface amounts to 85 percent of the total sieve surface. At the start of the filtration for about a minute a turbid filtrate comes out of the filter. During this time a filter cake of 5 mm height forms on the sieve. After a minute the turbid filtrate is returned to the filter, while under further growth of the filter cake solely clear filtrate runs out of the filter. The filtration of the 10 kg pitch charged is terminated after 12 minutes. A cake with a height of 70 mm has formed on the filter.

The filtrate is coked as in Example 1 and the coke has a graphitizability of 1.55.

EXAMPLE 3

10 kg of a raw briquette pitch with a softening point of 85° C. according to Kraemer-Sarnow was heated to 230° C. and placed within five minutes onto a metal pressure filter, which has a mesh size of 190 μm and a closed surface of 80 percent at a pressure of 2 bars. At the beginning of the filtration for a minute a turbid filtrate runs out of the metal pressure filter.

After a minute the pressure over the filter is slowly increased to 8 bar. After 8 minutes no substantial amounts of filtrate are obtained any more under the filter. The filter cake has reached a height of 60 mm.

The filtrate was coked according to Example 1 and had a graphitizability of 1.47.

The invention has been described at length in the foregoing, but it will be understood that many variations in details may be introduced without departure from the scope of the invention.

What is claimed is:

1. A method for production of needle coke, comprising the steps of liquifyng coal tar pitch at temperatures from aboout 135° C. to 280° C.; filtering the liquified coal tar pitch through a sieve having apertures from about 100 to 220 μm and a closed surface of at least 75 percent of the total sieve surface, under pressures from about 2 to 10 bar, until a filter cake of a height of from about 40 to 80 mm forms above the sieve for separating ash, soot and quinoline-insoluble parts from the liquid; and subjecting the filtrate obtained to a coking process.

2. The method for production of needle coke according to claim 1, comprising recirculating the filtrate obtained until a filter cake height of from about 2 to 5 mm is present to the liquefied coal tar pitch.

3. The method for production of needle coke according to claim 1, wherein the pressure above the sieve increases during filtration continuously from about 1 to 3 bar to about 6 to 10 bar.

4. The method for production of needle coke according to claim 1, wherein the pressure above the sieve increases during filtration in steps from about 1 to 3 bars to about 6 to 10 bar.

5. The method for production of needle coke according to claim 1, wherein an auxiliary filtering material is added to the liquefied coal tar pitch before filtering through the sieve.

* * * * *